US008584409B1

(12) United States Patent
Hibbard

(10) Patent No.: US 8,584,409 B1
(45) Date of Patent: Nov. 19, 2013

(54) STAIRWAY BARRICADE ASSEMBLIES AND METHODS

(71) Applicant: Victor Hibbard, Bullard, TX (US)

(72) Inventor: Victor Hibbard, Bullard, TX (US)

( * ) Notice: Subject to any disclaimer, the term of this patent is extended or adjusted under 35 U.S.C. 154(b) by 0 days.

(21) Appl. No.: 13/632,429

(22) Filed: Oct. 1, 2012

(51) Int. Cl.
*E04F 11/00* (2006.01)

(52) U.S. Cl.
USPC ..... 52/186; 52/65; 52/182

(58) Field of Classification Search
USPC ..... 52/65, 71, 182, 186; 256/73; 49/463–465; 160/215, 351
See application file for complete search history.

(56) References Cited

U.S. PATENT DOCUMENTS

| | | | | |
|---|---|---|---|---|
| 2,535,544 | A | 12/1950 | McKinley | |
| 3,225,863 | A | 12/1965 | Ludlow | |
| 3,968,857 | A | 7/1976 | Bryan | |
| 4,181,195 | A | 1/1980 | Clarke | |
| 4,524,848 | A | 6/1985 | Russo | |
| 4,558,851 | A * | 12/1985 | Nakayama | 256/24 |
| 4,579,197 | A | 4/1986 | Spurling | |
| 4,664,225 | A | 5/1987 | Coutier | |
| 4,881,619 | A | 11/1989 | Coutier | |
| 5,080,192 | A * | 1/1992 | Kerr | 182/17 |
| 5,402,988 | A * | 4/1995 | Eisele | 256/24 |
| 5,441,126 | A | 8/1995 | Orrick | |
| 5,718,414 | A * | 2/1998 | Deloach et al. | 256/24 |
| 7,500,655 | B1 * | 3/2009 | Smith et al. | 256/67 |
| 7,887,029 | B2 * | 2/2011 | Flannery | 256/73 |
| 2002/0066898 | A1 * | 6/2002 | Meis et al. | 256/73 |
| 2003/0009945 | A1 * | 1/2003 | Cheng | 49/57 |
| 2004/0000110 | A1 * | 1/2004 | Clover | 52/263 |
| 2004/0045222 | A1 * | 3/2004 | Hicks | 49/394 |
| 2006/0042163 | A1 * | 3/2006 | Nitz et al. | 49/55 |
| 2006/0092378 | A1 * | 5/2006 | Marsden et al. | 352/221 |
| 2006/0231821 | A1 * | 10/2006 | Gavin | 256/73 |
| 2008/0104888 | A1 * | 5/2008 | Holmes | 49/70 |
| 2008/0185566 | A1 * | 8/2008 | Flannery | 256/73 |
| 2009/0294747 | A1 * | 12/2009 | Stull | 256/73 |
| 2010/0236865 | A1 | 9/2010 | Crowton et al. | |
| 2011/0108790 | A1 * | 5/2011 | Cromie et al. | 256/73 |
| 2011/0193041 | A1 * | 8/2011 | Stull | 256/73 |
| 2012/0056144 | A1 * | 3/2012 | Woods et al. | 256/73 |
| 2012/0186066 | A1 | 7/2012 | Chilton | |
| 2012/0217460 | A1 * | 8/2012 | Bugh | 256/73 |
| 2013/0175489 | A1 * | 7/2013 | Volin | 256/73 |

* cited by examiner

*Primary Examiner* — Brian Glessner
*Assistant Examiner* — Patrick Maestri
(74) *Attorney, Agent, or Firm* — R. Keith Harrison

(57) ABSTRACT

A stairway barricade assembly includes a pair of barricade panels and a pair of barricade hinges carried by the pair of barricade panels, respectively, and adapted to pivotally attach the pair of barricade panels, respectively, to the stairway. Each of the barricade panels includes an outside panel portion adapted for positioning outside the stairway handrail, an inside panel portion extending from the outside panel portion and adapted for positioning inside the stairway handrail and a handrail slot between the outside panel portion and the inside panel portion. The handrail slot is adapted to accommodate a corresponding handrail of the stairway. The barricade panels are selectively pivotal between a closed position in which the inside panel portions block the stairway and an open position in which the inside panel portions unblock the stairway.

20 Claims, 7 Drawing Sheets

STAIRWAY BARRICADE ASSEMBLIES AND METHODS

FIELD

Illustrative embodiments of the disclosure generally relate to barricades. More particularly, illustrative embodiments of the disclosure relate to stairway barricade assemblies and methods which are suitable for selectively barricading a stairway to prevent unauthorized access to an elevated structure which is accessible using the stairway.

BACKGROUND

Owners of elevated structures which are accessible using stairways may be subjected to potential liability in the event that the structures are accessed by unauthorized persons. For example, the top of an outdoor oil storage tank typically may be accessed by climbing a stairway having multiple steps and a pair of handrails. In the event that an unauthorized person such as a child or adolescent accesses the top of the tank by climbing the stairway, the person may be injured by falling from the tank or igniting a cigarette in the presence of combustible liquids or vapors which are contained in or emanate from the tank, for example. Therefore, the owner of the structure or of the property on which the structure stands may potentially be subjected to liability.

Accordingly, stairway barricade assemblies and methods which are suitable for selectively barricading a stairway to prevent unauthorized access to a structure which is accessible using the stairway may be desirable for some applications.

SUMMARY

Illustrative embodiments of the disclosure are generally directed to a stairway barricade assembly for barricading a stairway having a pair of stairway handrails. An illustrative embodiment of the stairway barricade assembly includes a pair of barricade panels and a pair of barricade hinges carried by the pair of barricade panels, respectively, and adapted to pivotally attach the pair of barricade panels, respectively, to the stairway. Each of the barricade panels includes an outside panel portion adapted for positioning outside the stairway handrail, an inside panel portion extending from the outside panel portion and adapted for positioning inside the stairway handrail and a handrail slot between the outside panel portion and the inside panel portion. The handrail slot is adapted to accommodate a corresponding handrail of the stairway. The barricade panels are selectively pivotal between a closed position in which the inside panel portions block the stairway and an open position in which the inside panel portions unblock the stairway.

Illustrative embodiments of the disclosure are farther generally directed to a stairway barricade method for barricading a stairway having a pair of stairway handrails and a stairway space between the stairway handrails. An illustrative embodiment of the stairway barricade method includes providing a stairway barricade assembly including a pair of barricade panels each having an outside panel portion, an inside panel portion and a handrail slot between the outside panel portion and the inside panel portion; positioning the barricade panels such that a stairway handrail extends through the handrail slot with the outside panel portion disposed outside the stairway space and the inside panel portion disposed inside the stairway space; pivotally attaching the barricade panels to the stairway handrails, respectively; and blocking the stairway space by pivoting the barricade panels to a closed position and locking the barricade panels in the closed position.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature an is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "top", "bottom", "upwardly", "downwardly" and "side" are used for descriptive purposes herein and indicate the positions of the various components of the assembly relative to the corresponding are not intended to be construed in a limiting sense as the stairway barricade assembly may be used in alternative applications in which such relative terms do not apply.

Figure 2:
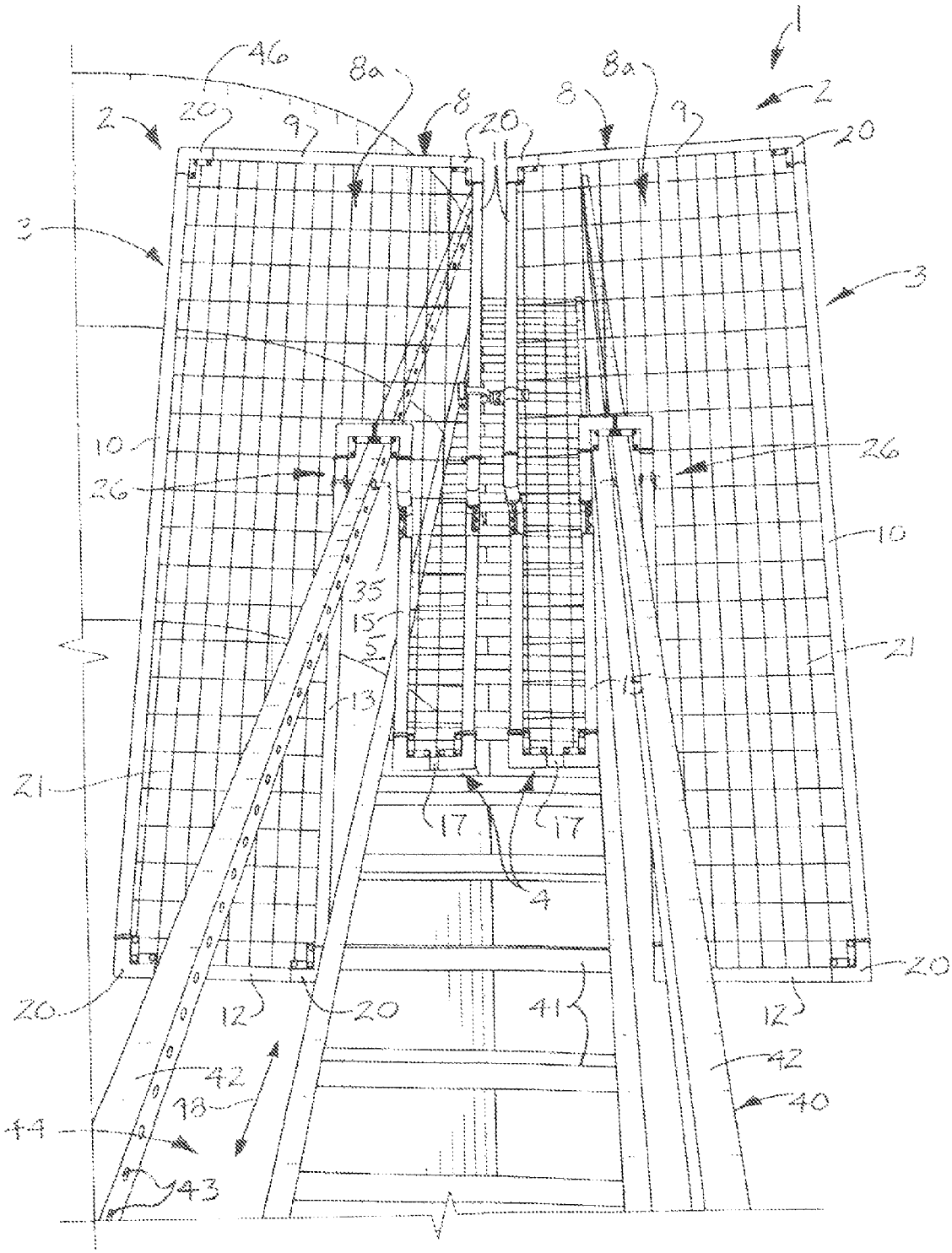
FIG. 2 is a front perspective view of an illustrative embodiment of the barricade panel assemblies, mounted on a stairway with the barricade panels latched in the closed position to prevent unauthorized access to the stairway.
Figure 3:
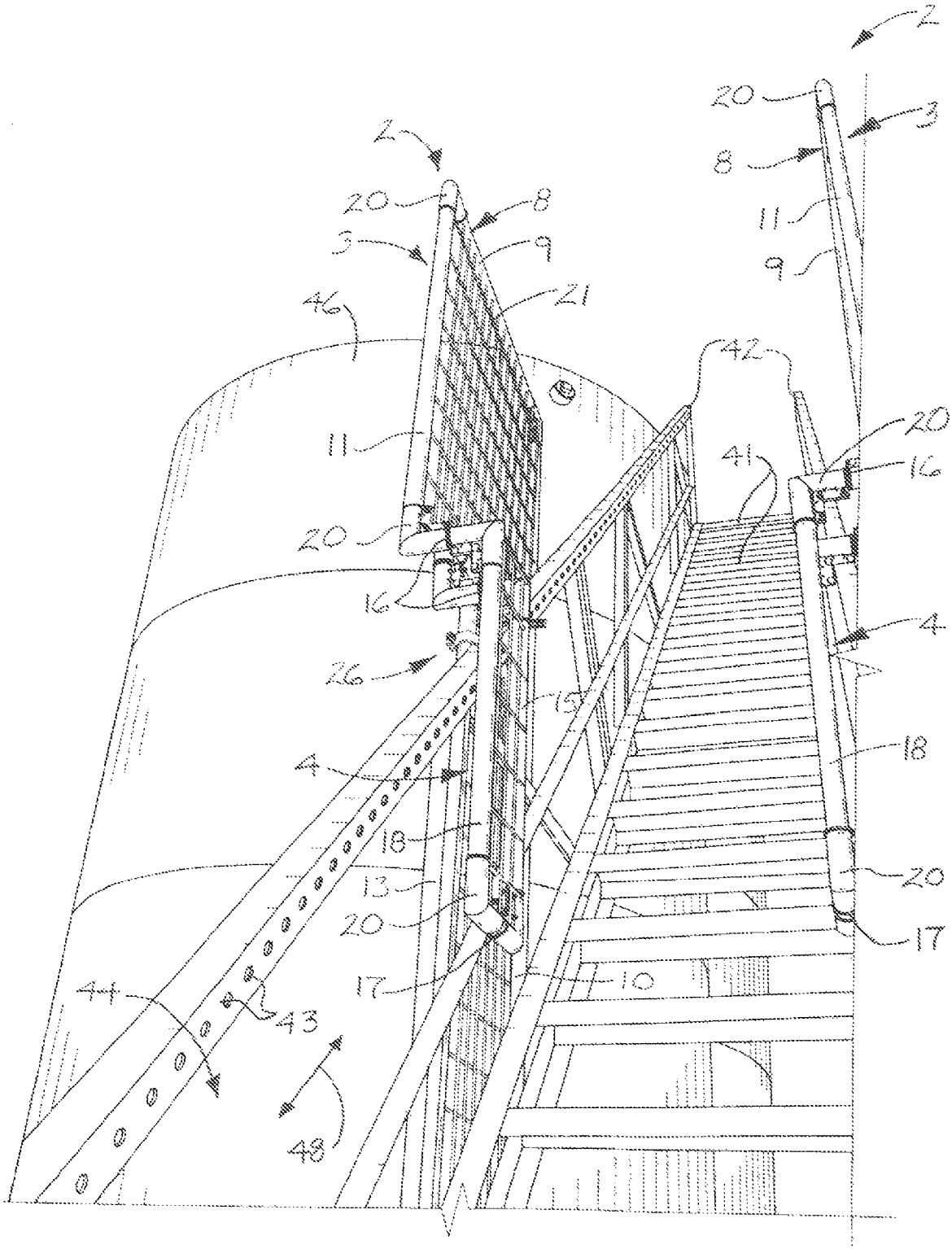
FIG. 3 is a front perspective view of an illustrative embodiment of the barricade panel assemblies, mounted on a stairway and deployed in an open position to permit access to the stairway.

Referring to the drawings, an illustrative embodiment of the stairway barricade assemblies is generally indicated by reference numeral 1. As illustrated in FIGS. 2 and 3 and will be hereinafter further described, the stairway barricade assembly 1 is suitable for selectively barricading a stairway 40 to prevent unauthorized personnel from accessing the top of an elevated structure such as an oil tank 46, for example and without limitation, at the top of the stairway 40. The stairway 40 may include stairway steps 41 and sloped stairway handrails 42 on opposite sides of the stairway steps 41. A stairway space 44 is above the stairway steps 41 and between the stairway handrails 42. The stairway barricade assembly 1 can be selectively locked in a closed position, as illustrated in FIG. 2, to barricade the stairway space 44 and prevent access of unauthorized personnel to the top of the oil tank 46 or other elevated structure. The stairway barricade assembly 1 can be selectively opened, as illustrated FIGS. 3-5, to facilitate access of authorized personnel to the top of the oil tank 46 or other elevated structure, as will be hereinafter further described.

Figure 1:
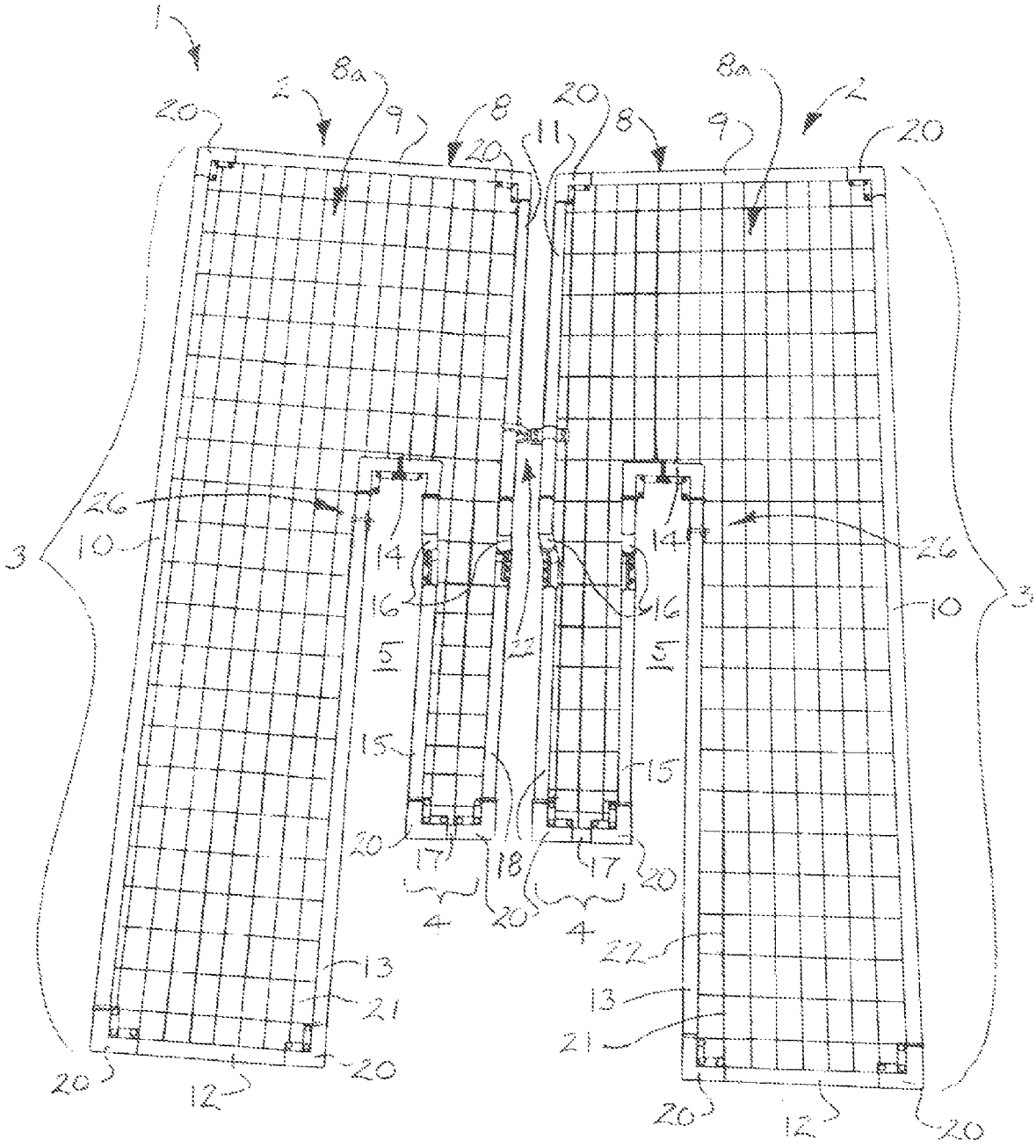
FIG. 1 is a front perspective view of an illustrative embodiment of the stairway barricade assemblies, deployed in a closed or latched position.

As illustrated in FIG. 1, the stairway barricade assembly 1 includes a pair of adjacent barricade panels 2. The barricade panels 2 may be pivotally attached to the respective stairway handrails 42 (FIGS. 2 and 3) of the stairway 40, as will be hereinafter described. Each barricade panel 2 may have a generally planar outside panel portion 3 and a generally planar inside panel portion 4 which extends from the outside panel portion 3. Each of the outside panel portion 3 and the inside panel portion 4 may be generally elongated. A handrail slot 5 may extend between the outside panel portion 3 and the inside panel portion 4 of each barricade panel 2 to accommodate the corresponding stairway handrail 42 of the stairway 40, as illustrated in FIG. 2. The handrail slot 5 may be generally elongated and rectangular, as illustrated. A barricade hinge 26 is provided on each of the outside panel portions 3, as illustrated, or alternatively, on each of the inside panel portions 4 and may interface with the handrail slot 5 to facilitate pivotal attachment of each barricade panel 2 to the corresponding stairway handrail 42. A barricade panel latch assembly 22 may facilitate selective securing and locking of the barricade panels 2 in the closed position, as will be hereinafter described.

Figure 1A:
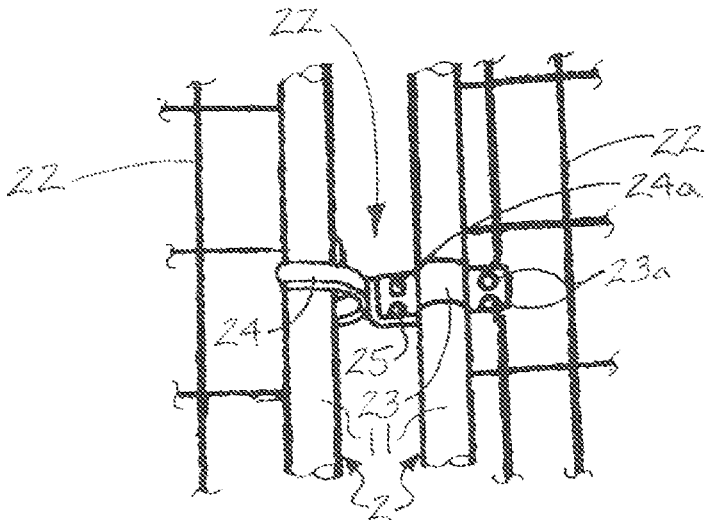
FIG. 1A is an enlarged sectional view illustrating an exemplary barricade panel latch which is suitable for latching a pair of adjacent barricade panels of an illustrative embodiment of the barricade panel assemblies in the closed position.
Figure 1B:
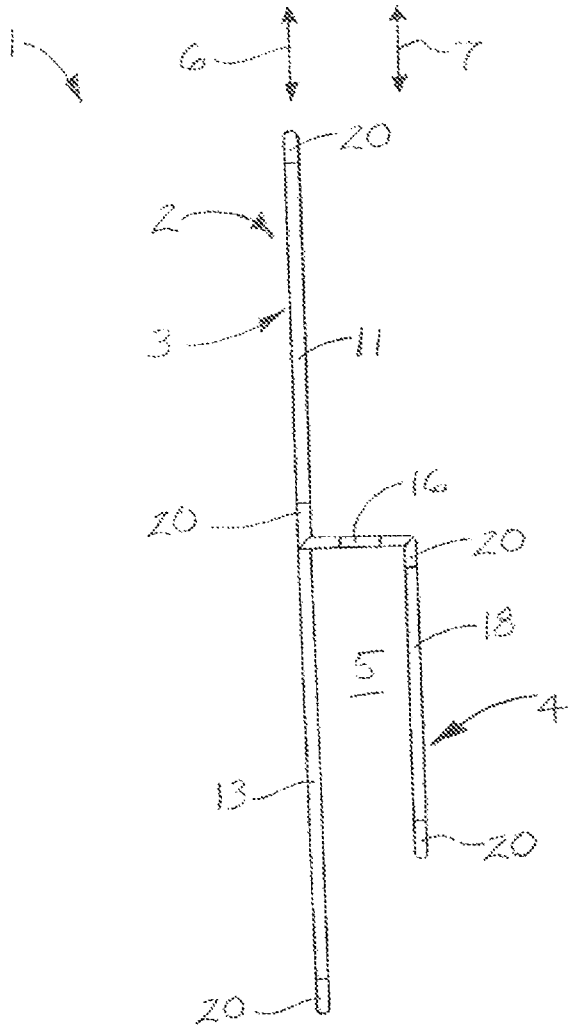
FIG. 1B is a side view of an exemplary barricade panel of an illustrative embodiment of the barricade panel assemblies.

As illustrated in FIG. 1B, the inside panel portion 4 may be offset relative to the outside panel portion 3 of each barricade panel 2 at the handrail slot 5. The plane 7 of the inside panel portion 4 may be generally parallel to the plane 6 of the outside panel portion 3. As further illustrated in FIG. 1B, in some embodiments, the outside panel portion 3 may extend or protrude downwardly beyond the inside panel portion 4.

As illustrated in FIG. 2, when the barricade panels 2 are pivotally mounted on the respective stairway handrails 42 of the stairway 40, the outside panel portions 3 are positioned outside the stairway space 44 whereas the inside panel portions 4 are positioned inside the stairway space 44. In the closed position of the stairway barricade assembly 1, as illustrated in FIG. 2, the planes 6, 7 (FIG. 1B) of each barricade panel 2 are generally perpendicular to a longitudinal axis 48 (FIG. 2) of the corresponding stairway handrail 42. The inside panel portions 4 of the respective barricade panels 2 are adjacent to each other and block unauthorized access through the stairway space 44. The outside panel portions 3 of the respective barricade panels 2 extend to the outside of the respective stairway handrails 42.

Figure 4:
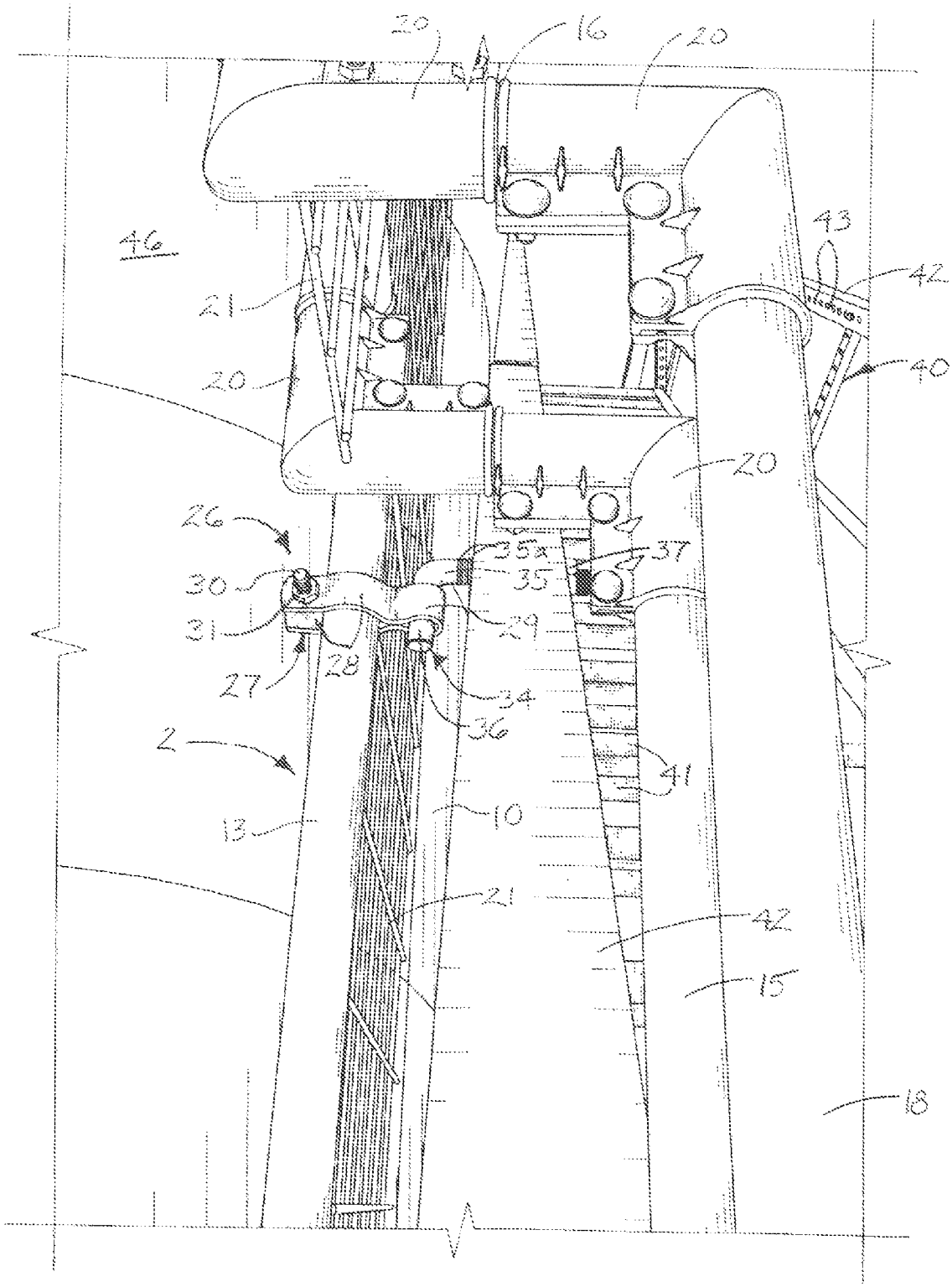
FIG. 4 is an enlarged sectional view illustrating an exemplary barricade hinge suitable for pivotally mounting each barricade panel of an illustrative embodiment of the barricade panel assemblies to a handrail of the stairway.
Figure 5:
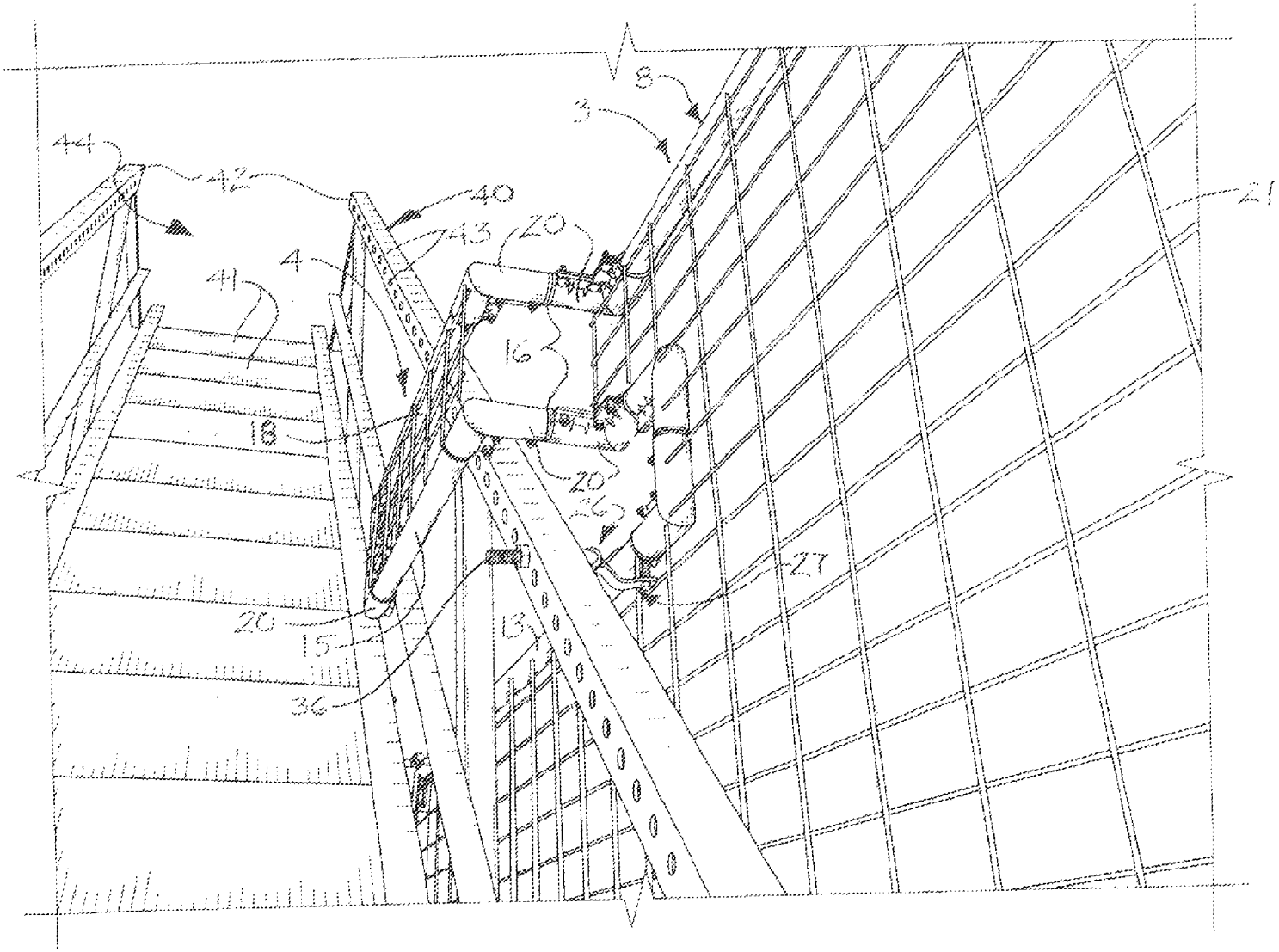
FIG. 5 is a rear perspective view of a barricade panel of an illustrative embodiment of the barricade panel assemblies, deployed in the open position.

As illustrated in FIGS. 3-5, in the open position of the stairway barricade assembly 1, the planes 6, 7 (FIG. 1B) of each barricade panel 2 are generally parallel to the longitudinal axis 48 of the corresponding stairway handrail 42. Due to the offset position of the inside panel portion 4 relative to the outside panel portion 3, the outside panel portion 3 of each barricade panel 2 is positioned outside the stairway space 44 whereas the inside panel portion 4 of each barricade panel 2 is positioned inside the stairway space 44.

As further illustrated in FIG. 1, each barricade panel 2 may include a barricade panel frame 8 having a frame opening 8*a*. In some embodiments, a panel mesh 21 may be provided in the frame opening 8*a* at each barricade panel frame 8. In other embodiments, each barricade panel 2 may have a solid construction in which a solid panel material fills the frame opening 8*a*. Each barricade panel frame 8 may have a size, shape and design which are consistent with the functional requirements of the stairway barricade assembly 1. Each barricade panel 2 may be constructed of aluminum, steel, other metal, composite material or other material and/or any combination thereof.

In some embodiments, each barricade panel frame 8 may be fabricated with multiple frame segments. Accordingly, the barricade panel frame 8 may have an elongated top panel frame segment 9. An elongated outside panel frame segment 10 and an elongated upper inside panel frame segment 11 may extend from opposite ends of the top panel frame segment 9 in parallel, spaced-apart relationship to each other. An elongated bottom outside portion frame segment 12 may extend from a lower end of the outside panel frame segment 10 in parallel, spaced-apart relationship to the top panel frame segment 9. An elongated outside slot segment 13 may extend from the bottom outside portion frame segment 12 in parallel, spaced-apart relationship to the outside panel frame segment 10. A top slot segment 14 may extend perpendicularly from the outside slot segment 13. An inside slot segment 15 may extend from the top slot segment 14 in parallel, spaced-apart relationship to the outside slot segment 13. An offset connecting segment 16 may connect the inside slot segment 15 to the top slot segment 14. The handrail slot 5 may be defined by and between the outside slot segment 13, the top slot segment 14, the inside slot segment 15 and the offset connecting segment 16.

A bottom inside portion frame segment 17 may extend perpendicularly from the inside slot segment 15. A lower inside panel frame segment 18 may extend from the bottom inside portion frame segment 17 in parallel, spaced-apart relationship to the inside slot segment 15. An offset connecting segment 16 may connect the upper inside panel frame segment 11 to the lower inside panel frame segment 18. Accordingly, as illustrated in FIG. 1B, the offset connecting segments 16 may impart the offset position of the inside panel portion 4 relative to the outside panel portion 3 of each barricade panel 2. The various frame segments in each barricade panel 2 may be connected by frame segment elbow connectors 20. In other embodiments, the barricade panel frame 8 may be fabricated in a continuous piece via casting, molding and/or other fabrication techniques known by those skilled in the art.

Each barricade hinge 26 may have any design which is suitable for the purpose of pivotally attaching each barricade panel 2 to the corresponding stairway handrail 42. As illustrated in FIG. 4, in some embodiments, each barricade hinge 26 may include a hinge bolt 34 which is attached to the corresponding stairway handrail 42. The hinge bolt 34 may be generally L-shaped, with an elongated bolt shaft 35 which may have shaft threads 35*a* and is extended through a bolt opening 43 in the stairway handrail 42 and a bolt head 36 which extends perpendicularly from the bolt shaft 35. In some embodiments, a nut 37 (FIG. 4) may be threaded on the shaft threads 35*a* and tightened against the stairway handrail 42 to secure the bolt shaft 35 in the bolt opening 43. In other embodiments, the bolt shaft 35 may be welded or otherwise permanently attached to the stairway handrail 42.

A hinge bracket 27 is attached to and extends from the bolt head 36 of the hinge bolt 34. The hinge bracket 27 receives and supports the outside slot segment 13 or other frame segment or component of the barricade panel 2. The hinge bracket 27 may include a looped bolt-receiving portion 29 which receives the bolt head 36 of the hinge bolt 34. The bolt-receiving portion 29 may be welded and/or otherwise attached to the bolt head 36 of the hinge bolt 34 according to the knowledge of those skilled in the art. A pair of spaced-apart hinge bracket arms 28 may extend from the bolt-receiving portion 29. The hinge bracket arms 28 may be concave to receive the complementary-shaped outside slot segment 13 or other frame segment of the barricade panel frame 8. A bracket bolt 30, secured by a threaded nut 31, may extend through registering bolt openings (not illustrated) in the hinge bracket arms 28 to secure the hinge bracket arms 28 around the outside slot segment 13. Accordingly, the outside slot segment 13 of the barricade panel frame 8 rotates between the hinge bracket arms 28 as the barricade panel 2 is deployed between the closed position of FIGS. 1 and 2 and the open position of FIGS. 3-5. It will be recognized and understood that the foregoing description of the barricade hinge 26 is exemplary and that any alternative type or design of hinge which is suitable for the purpose of pivotally attaching each barricade panel 2 to the corresponding stairway handrail 42 may be used instead for the purpose. For example and without limitation, in some embodiments, the hinge bracket 27 may be welded and/or otherwise attached to the stairway handrail 42 according to the knowledge of those skilled in the art, either directly or indirectly through a hinge bolt 34 or other structure which is functionally equivalent to the hinge bolt 34.

The barricade panel latch assembly 22 may have any design which is suitable for the purpose of latching the barricade panels 2 to each other in the closed position (FIGS. 1 and 2) of the stairway barricade assembly 1. As illustrated in FIG. 1A, in some embodiments, the barricade panel latch assembly 22 may include a latch bracket 23 which may be attached to the upper inside panel frame segment 11 of a first one of the adjacent barricade panels 2 such as via bracket fasteners 23*a*. A latch 24 may be pivotally attached to the latch bracket 23 via a pivot pin 24*a* for engaging the upper inside panel frame segment 11 on the adjacent second one of the barricade panels 2. Registering lock openings 25 may extend through the latch bracket 23 and the latch 24, respectively. Accordingly, the latch 24 can be selectively pivoted with respect to the latch bracket 23 to receive the upper inside panel frame segment 11 of the second barricade panel 2, as illustrated in FIG. 1A, and secure the adjacent barricade panels 2 in the closed position of FIGS. 1 and 2. A padlock (not illustrated) can be extended through the registering lock openings 25 to lock the latch 24 in the closed position. Conversely, the latch 24 can be selectively pivoted to disengage the upper inside panel frame segment 11 on the second barricade panel 2 and facilitate pivoting of the barricade panels 2 from the closed position (FIGS. 1 and 2) to the open position (FIGS. 3-5). It will be recognized and understood that the foregoing description of the barricade panel latch assembly 22 is exemplary and that any alternative type or design of latch or locking mechanism which is suitable for the purpose of latching or locking the barricade panels 2 to each other in the closed position may be used instead for the purpose.

In exemplary application of the stairway barricade assembly 1, each barricade panel 2 is pivotally attached to the corresponding stairway handrail 42 of the stairway 40 via the barricade hinge 26, typically as was heretofore described. Accordingly, as illustrated in FIG. 2, each stairway handrail 42 extends through the handrail slot 5 of the corresponding barricade panel 2. The outside panel portion 3 and the inside panel portion 4 are disposed on the exterior and interior sides, respectively, of the stairway handrail 42. The barricade assembly 1 may be mounted on the stairway 40 at such a height that unauthorized personnel would encounter difficulty in climbing over one of the stairway handrails 42 behind or above the barricade assembly 1 in an attempt to circumvent the stairway-blocking function of the barricade assembly 1.

The barricade panels 2 are deployed in the closed position illustrated in FIGS. 1 and 2 such that the inside panel portions 4 of the respective barricade panels 2 block the stairway space 44 of the stairway 40. The latch 24 of the barricade panel latch assembly 22 is pivoted to the latching position illustrated in FIG. 1A to secure the barricade panels 2 in the closed position. A padlock (not illustrated) is extended through the registering lock openings 25 in the latch bracket 23 and the latch 24, respectively, and secured. It will be appreciated by those skilled in the art that the inside panel portions 4 of the barricade panels 2 block access of unauthorized personnel via the stairway space 44 to the top of the oil tank 46 or other elevated structure. Moreover, the outside panel portions 3 extend outwardly from the respective barricade handrails 42 to prevent unauthorized personnel from climbing around the barricade panels 2 on the outside of the handrails 42 in an attempt to circumvent the inside panel portions 4.

Under circumstances in which access to the stairway space 44 to the top of the elevated structure is to be provided to authorized personnel, the padlock (not illustrated) is unlocked and removed from the lock openings 25 (FIG. 1A) in the barricade panel latch assembly 22. The latch 24 is disengaged from the barricade panel 2 and the barricade panels 2 are pivoted to the open position of FIGS. 3-5. In some embodiments, the stairway barricade assembly 1 can be selectively removed from the stairway 40 by removal of each barricade panel 2 from the corresponding stairway handrail 42. This may be accomplished by first removing the bracket bolt 30 (FIG. 4) from the hinge bracket arms 28, removing the outside slot segment 13 of the barricade panel 2 from between the hinge bracket arms 28 of the hinge bracket 27, unthreading the nut 37 (FIG. 4) from the exterior nut threads 35*a* on the bolt shaft 35 of the hinge bolt 34 and removing the bolt shaft 35 from the bolt opening 43 in the stairway handrail 42.

Figure 6:
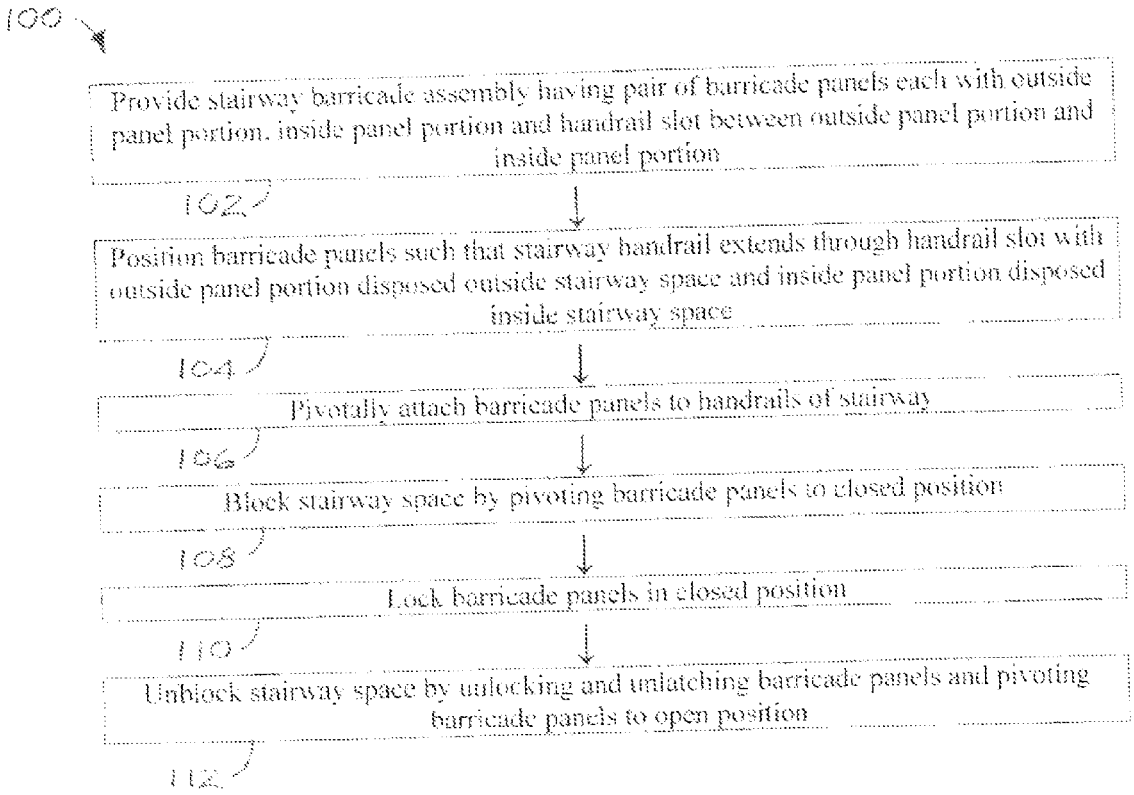
FIG. 6 is a flow diagram of an illustrative embodiment of a stairway barricade method.

Referring next to FIG. 6 of the drawings, a flow diagram 100 which designates an illustrative embodiment of a stairway barricade method is illustrated. In block 102, a stairway barricade assembly is provided. The stairway barricade assembly may include a pair of barricade panels each with an outside panel portion, an inside panel portion and a handrail slot between the outside panel portion and the inside panel portion. In some embodiments, the inside panel portion may be offset relative to the outside panel portion at the handrail slot. In block 104, the barricade panels may be positioned such that a stairway handrail extends through the handrail slot with the outside panel portion disposed outside the stairway space and the inside panel portion disposed inside the stairway space. In block 106, the barricade panels may be pivotally attached to the respective stairway handrails of the stairway. In some embodiments, each of the barricade panels may be fitted with a barricade hinge including a hinge bolt and a hinge bracket attached to the hinge bolt. The hinge bolt of the barricade hinge may be attached to a corresponding one of the stairway handrails. The barricade panel may be pivotally attached to the hinge bracket of the barricade hinge.

In block 108, the stairway space may be selectively blocked by pivoting the barricade panels to a closed position. In block 110, the barricade panels may be locked in the closed position. In some embodiments, the barricade panels may be fitted with a barricade panel latch assembly. Locking the barricade panels in the closed position may include latching the barricade panels in the closed position using the barricade panel latch assembly and locking the barricade panel latch assembly using a padlock or the like. In block 112, the stairway space is selectively unblocked by unlocking and unlatching the barricade panels and then pivoting the barricade panels to the open position.

While illustrative embodiments of the disclosure have been described above, it will be recognized and understood that various modifications can be made and the appended claims are intended to cover all such modifications which may fall within the spirit and scope of the disclosure.

What is claimed is:

1. A stairway barricade assembly for barricading a stairway having a pair of stairway handrails, comprising:

a pair of barricade panels;

a pair of barricade hinges carried by the pair of barricade panels, respectively, pivotally attaching the pair of barricade panels, respectively, to the stairway;

each of the barricade panels including:

an outside panel portion positioned outside the stairway handrail;

an inside panel portion extending from the outside panel portion and positioned inside the stairway handrail; and a handrail slot between the outside panel portion and the inside panel portion, the handrail slot accommodating a corresponding handrail of the stairway; and the barricade panels selectively pivotal between a closed position whereby the inside panel portions block the stairway and an open position whereby the inside panel portions unblock the stairway.

2. The stairway barricade assembly of claim 1 wherein the inside panel portion is offset from the outside panel portion at the handrail slot.

3. The stairway barricade assembly of claim 1 further comprising a barricade panel latch assembly carried by the pair of barricade panels to selectively secure the pair of barricade panels in the closed position.

4. The stairway barricade assembly of claim 3 wherein the barricade panel latch assembly comprises a latch bracket carried by a first one of the pair of barricade panels and a latch pivotally carried by the latch bracket to engage the second one of the pair of barricade panels.

5. The stairway barricade assembly of claim 1 wherein each of the pair of barricade binges comprises a hinge bolt attached to a corresponding stairway handrail and a hinge bracket carried by the hinge bolt, and wherein a corresponding one of the pair of barricade panels is pivotally carried by the hinge bracket.

6. The stairway barricade assembly of claim 5 wherein the hinge bolt comprises a bolt shaft engaging the stairway handrail and a bolt head extending perpendicularly from the bolt shaft, and wherein the hinge bracket is carried by the bolt head.

7. The stairway barricade assembly of claim 1 wherein each of the pair of barricade panels comprises a barricade panel frame having a frame opening and a panel mesh in the frame opening.

8. The stairway barricade assembly of claim 1 wherein each of the outside panel portion and the inside panel portion is generally elongated.

9. A stairway barricade assembly for barricading a stairway having a pair of stairway handrails, comprising:

a pair of adjacent barricade panels;

a pair of barricade hinges carried by the pair of barricade panels, respectively, pivotally attaching the pair of barricade panels to the stairway handrails, respectively, of the stairway;

each of the barricade panels including:

a generally planar outside panel portion positioned outside the stairway handrail;

a generally planar inside panel portion extending from the outside panel portion and positioned inside the stairway handrail;

a generally elongated, rectangular handrail slot between the outside panel portion and the inside panel portion, the handrail slot accommodating a corresponding stairway handrail and the inside panel portion offset with respect to the outside panel portion at the handrail slot; and the barricade panels selectively pivotal between a closed position whereby the inside panel portions block the stairway and an open position whereby the inside panel portions unblock the stairway.

10. The stairway barricade assembly of claim 9 further comprising a barricade panel latch assembly carried by the pair of barricade panels to selectively secure the pair of barricade panels in the closed position.

11. The stairway barricade assembly of claim 10 wherein the barricade panel latch assembly comprises a latch bracket carried by a first one of the pair of barricade panels and a latch pivotally carried by the latch bracket to engage the second one of the pair of barricade panels.

12. The stairway barricade assembly of claim 9 wherein each of the pair of barricade hinges comprises a hinge bolt attached to a corresponding stairway handrail and a hinge bracket carried by the hinge bolt, and wherein a corresponding one of the pair of barricade panels is pivotally carried by the hinge bracket.

13. The stairway barricade assembly of claim 12 wherein the hinge bolt comprises a bolt shaft engaging the stairway handrail and a bolt head extending perpendicularly from the bolt shaft, and wherein the hinge bracket is carried by the bolt head.

14. The stairway barricade assembly of claim 9 wherein each of the pair of barricade panels comprises a barricade panel frame having a frame opening and a panel mesh in the frame opening.

15. The stairway barricade assembly of claim 9 wherein each of the outside panel portion and the inside panel portion is generally elongated.

16. The stairway barricade assembly of claim 9 wherein each of the pair of barricade hinges is carried by the inside panel portion and interfaces with the handrail slot of a corresponding one of the pair of barricade panels.

17. A stairway barricade method for barricading a stairway having a pair of stairway handrails and a stairway space between the stairway handrails, comprising:

providing a stairway barricade assembly including a pair of barricade panels each having an outside panel portion, an inside panel portion and a handrail slot between the outside panel portion and the inside panel portion;

positioning the barricade panels such that a stairway handrail extends through the handrail slot with the outside panel portion disposed outside the stairway space and the inside panel portion disposed inside the stairway space;

pivotally attaching the barricade panels to the stairway handrails, respectively;

blocking the stairway space by pivoting the barricade panels to a closed position; and locking the barricade panels in the closed position.

18. The stairway barricade method of claim 17 further comprising unblocking the stairway space by unlocking the barricade panels and pivoting the barricade panels to an open position.

19. The stairway barricade method of claim 17 wherein providing a stairway barricade assembly including a pair of barricade panels comprises providing a pair of barricade panels having a barricade panel latch assembly and wherein locking the barricade panels in the dosed position comprises latching the barricade panels in the closed position using the barricade panel latch assembly.

20. The stairway barricade method of claim 17 wherein pivotally attaching the barricade panels to the stairway handrails, respectively, comprises providing a barricade hinge including a hinge bolt and a hinge bracket carried by the hinge bolt; attaching the hinge bolt to a corresponding one of the stairway handrails; and pivotally attaching a corresponding one of the pair of barricade panels to the hinge bracket.

* * * * *